US005823779A

United States Patent [19]

Muehle et al.

[11] Patent Number: 5,823,779

[45] Date of Patent: Oct. 20, 1998

[54] ELECTRONICALLY CONTROLLED WEAPONS RANGE WITH RETURN FIRE

[75] Inventors: Eric G. Muehle; Irwin C. Treat, Jr., both of Maple Valley, Wash.

[73] Assignee: Advanced Interactive Systems, Inc., Tukwila, Wash.

[21] Appl. No.: 644,445

[22] Filed: May 2, 1996

[51] Int. Cl.[6] ..... F41G 3/26

[52] U.S. Cl. ..... 434/121; 434/19; 434/20; 463/5; 463/7; 463/52

[58] Field of Search ..... 434/11, 16–27, 434/247; 463/2, 5, 51, 52, 7; 235/411; 364/578; 340/573; 273/358; 348/61, 121

[56] References Cited

U.S. PATENT DOCUMENTS

| | | |
|---|---|---|
| 1,197,567 | 9/1916 | Weeks . |
| 2,362,473 | 11/1944 | Dunham . |
| 2,404,653 | 7/1946 | Olebanek ..... 463/52 X |
| 3,047,723 | 7/1962 | Knapp . |
| 3,341,204 | 9/1967 | McDannold . |
| 3,398,958 | 8/1968 | Sanzare . |
| 3,411,785 | 11/1968 | Molina et al. . |
| 3,590,225 | 6/1971 | Murphy . |
| 3,619,630 | 11/1971 | McLeod et al. . |
| 3,623,065 | 11/1971 | Rockwood et al. . |
| 3,727,069 | 4/1973 | Crittenden, Jr. et al. . |
| 3,807,858 | 4/1974 | Finch . |
| 3,849,910 | 11/1974 | Greenly . |
| 3,996,674 | 12/1976 | Pardes et al. . |
| 4,019,262 | 4/1977 | Breglia et al. . |
| 4,150,825 | 4/1979 | Wilson . |
| 4,204,683 | 5/1980 | Filippini et al. . |
| 4,222,564 | 9/1980 | Allen et al. . |
| 4,281,241 | 7/1981 | Knight et al. . |
| 4,290,757 | 9/1981 | Marshall et al. . |
| 4,324,977 | 4/1982 | Brauer . |
| 4,514,625 | 4/1985 | Heiland . |
| 4,523,761 | 6/1985 | Huscher . |

(List continued on next page.)

FOREIGN PATENT DOCUMENTS

| | | |
|---|---|---|
| 33 32 582 | 3/1985 | Germany . |
| 3 507 400 A1 | 9/1985 | Germany . |
| 665 901 A5 | 6/1988 | Switzerland . |
| 459313 | 1/1937 | United Kingdom . |
| 536641 | 5/1941 | United Kingdom . |
| 545196 | 5/1942 | United Kingdom . |
| 1 246 271 | 9/1971 | United Kingdom . |
| 1 522 832 | 8/1978 | United Kingdom . |
| 1 527 883 | 10/1978 | United Kingdom . |
| 2 035 523 | 6/1980 | United Kingdom . |
| WO 94/03246 | 2/1994 | WIPO . |

OTHER PUBLICATIONS

Vacca, J., "Dismounted Infanty Virtual Environment (DIVE) technology," *Virtual Reality Special Report*, pp. 48–52, Nov./Dec. 1995.

*Primary Examiner*—Joe Cheng
*Attorney, Agent, or Firm*—Seed and Berry LLP

[57] ABSTRACT

A weapons training range provides a simulated weapons use scenario including return fire. A microprocessor selects branches from a multi-branch program and causes an image projector to project subscenarios on a display screen visible to a participant. In response to the subscenarios, the participant fires at projected threats. Return fire simulators positioned behind the display screen return fire toward the participant. Obstructions are placed in the weapons range to provide cover for the participant. A video camera and X-Y position sensor identify the X-Y location of the participant and try to detect exposed portions of the participant. Based upon the identified X-Y location and any detected exposed portions, the microprocessor aims the return fire simulators to provide simulated return fire. To simulate real world aiming, the microprocessor induces time-based and response-based aiming errors. Additionally, the microprocessor may aim the return fire simulators at objects in the participation zone to produce deflected fire that may also strike the participant.

54 Claims, 6 Drawing Sheets

U.S. PATENT DOCUMENTS 4,533,144 8/1985 Juarez et al. ..... 434/21 X
4,611,993 9/1986 Brown .
4,657,511 4/1987 Allard et al. .
4,680,012 7/1987 Morley et al. .
4,685,330 8/1987 Ford .
4,695,058 9/1987 Carter, III et al. ..... 463/5
4,695,256 9/1987 Eichweber .
4,702,475 10/1987 Elstein et al. ..... 434/247 X
4,763,903 8/1988 Goodwin et al. .
4,788,441 11/1988 Laskowski .
4,789,932 12/1988 Cutler et al. .
4,804,325 2/1989 Willits et al. .
4,934,937 6/1990 Judd ..... 463/52 X
4,948,371 8/1990 Hall .
4,949,972 8/1990 Goodwin et al. .
4,988,111 1/1991 Gerlizt et al. .
5,194,006 3/1993 Zaenglein, Jr. .
5,213,503 5/1993 Marshall et al. .
5,215,464 6/1993 Marshall et al. ..... 434/20 X
5,273,291 12/1993 Giannetti .
5,320,358 6/1994 Jones ..... 463/2 X
5,320,362 6/1994 Bear et al. ..... 463/5
5,328,190 7/1994 Dart et al. .
5,333,874 8/1994 Arnold et al. .
5,596,509 1/1997 Karr et al. ..... 235/411
5,599,187 2/1997 Mesiano ..... 434/19
5,613,913 3/1997 Ikematsu et al. ..... 463/52
5,641,288 6/1997 Zaenglein, Jr. ..... 434/21

ELECTRONICALLY CONTROLLED WEAPONS RANGE WITH RETURN FIRE

TECHNICAL FIELD

The present invention relates to simulated weapons use environments, and more particularly to simulated weapons use environments with return fire.

BACKGROUND OF THE INVENTION

Weapons ranges provide environments in which users can be trained in the use of weapons or can refine weapons use skills. At such weapons ranges, users may train with conventional firearms, such as pistols and rifles, or may use a variety of alternative weapons, such as bows and arrows. Also, users may wish to train in more exotic or more primitive weapons, such as spears or slingshots.

Regardless of the type of weapon used, weapons ranges typically include a participation zone in which the participant is positioned. The participant then projects some form of projectile from the participation zone toward a target. For example, a participant may fire a pistol from a shooting location toward a bull's-eye paper target. Similarly, a participant may fire arrows from a shooting location toward a pin cushion-type target.

To improve the realism of the weapons familiarization process and to provide a more "lifelike" experience, a variety of approaches have been suggested to make the weapons range more realistic. For example, some weapons ranges provide paper targets with threatening images, rather than bull's-eye targets.

In attempts to present a more realistic scenario to the participant to provide an interactive and immersive experience, some weapons ranges have replaced such fixed targets with animated video images, typically projected onto a display screen. The animated images present moving targets and/or simulated return threats toward which the participant fires.

In one such environment, described in U.S. Pat. No. 3,849,910, to Greenly, a participant fires at a display screen upon which an image is projected. A position detector then identifies the "hit" location of bullets and compares the hit location to a target area to evaluate the response of the participant.

In an attempt to provide an even more realistic simulation to the participant, U.S. Pat. No. 4,695,256, to Eichweber, incorporates a calculated projectile flight time, target distance, and target velocity to determine the hit position. Similarly, United Kingdom Patent No. 1,246,271, to Foges et al., teaches freezing a projected image at an anticipated hit time to provide a visual representation of the hit.

While such approaches may provide improve visual approximations of actual situations as compared to paper targets, these approaches lack any threat of retaliation. A participant is thus less likely to react in a realistic fashion.

Rather than limiting themselves to such unrealistic experiences, some participants engage in simulated combat or similar experiences, through combat games such as laser tag or paint ball. In such games, each participant is armed with a simulated fire-producing weapon in a variety of scenarios. Such combat games have limited effectiveness in training and evaluation, because the scenarios experienced by the participants cannot be tightly controlled. Moreover, combat games typically require multiple participants and a relatively large area for participation.

SUMMARY OF THE INVENTION

An electronically controlled weapons range environment includes electronically activated return fire simulators that emit simulated return fire toward a participant. In a preferred embodiment of the invention, the weapons range environment includes a target zone that contains a display screen, impact sensors, a video camera, and return fire simulators. An image projector presents selected scenarios on the display screen and the impact sensors detect a participant's simulated fire directed toward the display screen in response. As part of the scenario, the return fire simulators emit nonlethal return fire, such as actual projectiles, toward the participant. To further improve the realism of the weapons range environment, speakers emit sounds corresponding to the simulated scenario.

The return fire simulators are electronically aimed by respective aiming servos that can sweep the return fire horizontally and elevationally. To determine the aiming location of the return fire simulators, the central controller receives image information from the video camera and attempts to identify exposed portions of the participant. In response to the information from the video camera, the central controller controls the aiming servos and activates the return fire simulators to direct simulated return fire toward the participant.

Obstructions are positioned between the return fire simulators and the participant to provide cover for the participant. In such multiuser environments, each participant's fire is monitored through separate, wavelength selective impact sensors. To aid in rough aiming of the return fire simulators and to help the central controller identify the participant's location when the participant is concealed behind the obstructions, an X-Y sensor lies beneath the participation zone.

In another embodiment, an overhead camera is positioned above the participation zone to provide image information to the central controller. In this embodiment, the central controller can track the position of more than one participant.

To further improve the realism of the environment, the central controller imposes a time-based inaccuracy and a damage-based inaccuracy on the return fire. The time-based inaccuracy simulates gradual refinement of an enemy's aim over time. The damage-based inaccuracy simulates the effect of nonlethal hits on the enemy's aim.

DETAILED DESCRIPTION OF THE INVENTION

Figure 1:
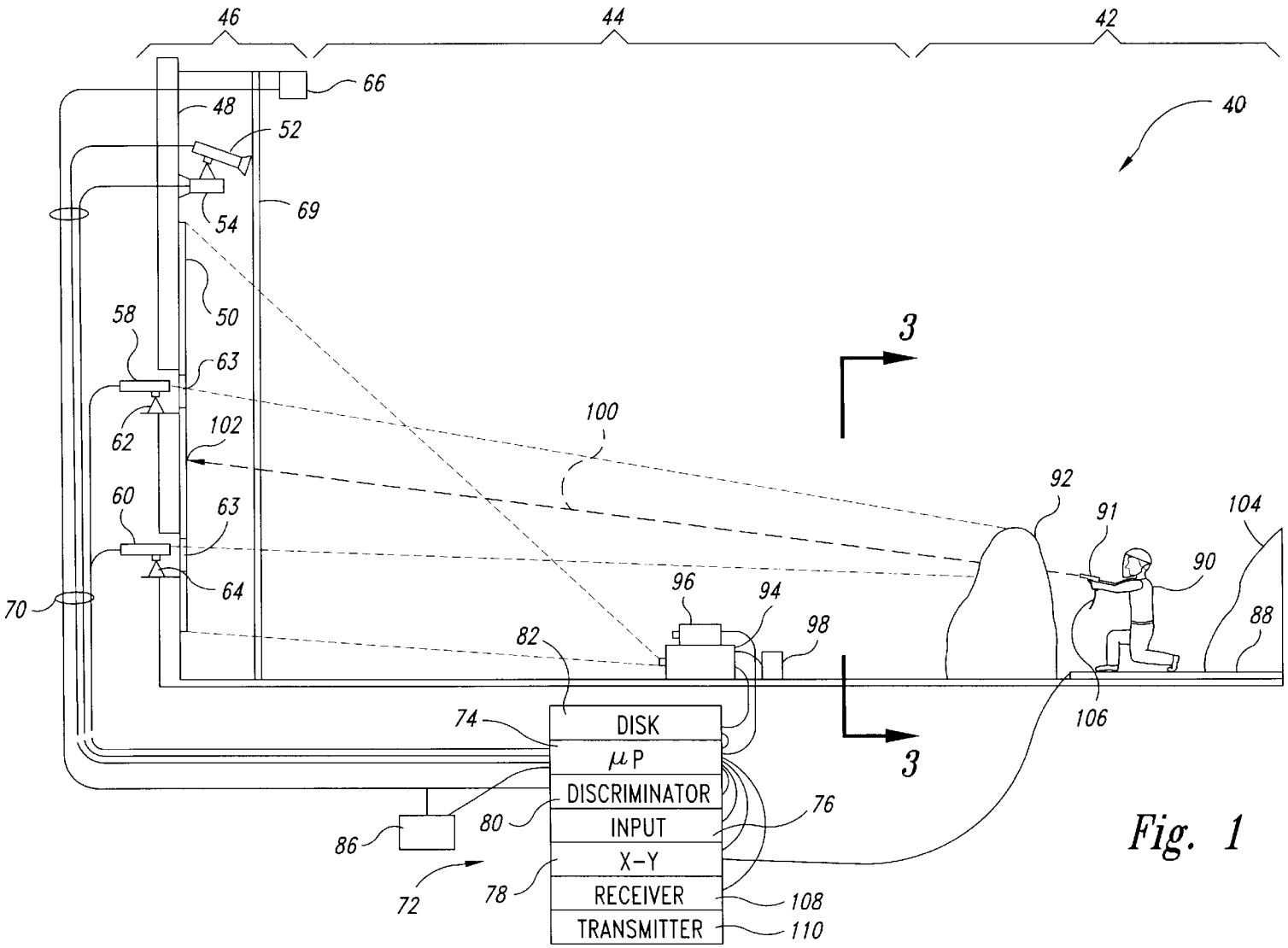
FIG. 1 is a side elevational view of an electronically controlled weapons range having return fire simulators.
Figure 2:
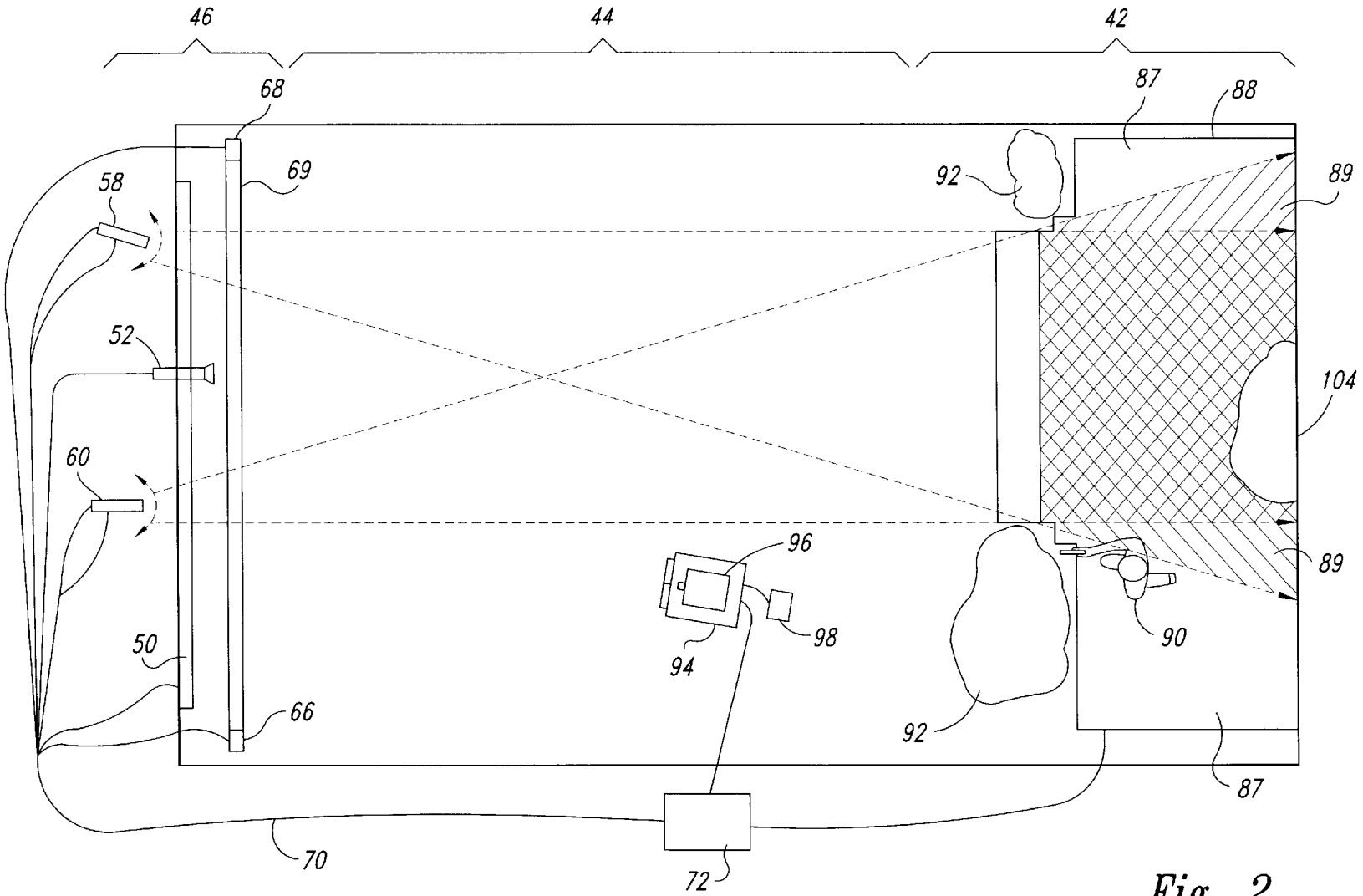
FIG. 2 is a top plan view of the weapons range of FIG. 1 showing exposed and obscured regions for the return fire simulators.
Figure 3:
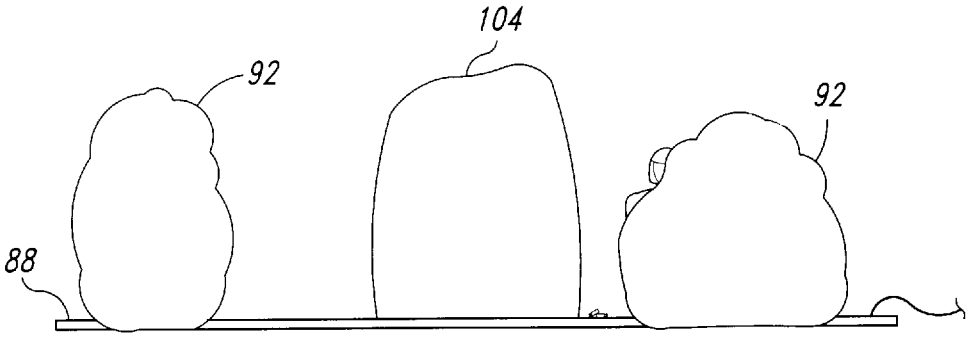
FIG. 3 is a cross-sectional elevational view of the weapons range of FIG. 1 taken along the line 3—3 and showing partial concealment of the participant.

As shown in FIGS. 1, 2 and 3, a weapons training range 40 is broken into three adjacent zones, a participation zone 42, an intermediate zone 44, and a target zone 46. Additionally, a microprocessor based central controller 72 is positioned outside of the zones 42, 44, 46 to control, monitor and evaluate activities within the zones 42, 44, 46. The structure and operation of the central controller 72 will be described in greater detail below.

The target zone 46 is the zone in which a simulated scenario is presented and toward which a participant 90 will fire. The target zone 46 includes a rear wall 48 carrying a display screen 50 that faces the participation zone 42. The display screen 50 is any suitable display screen upon which a readily visible image can be projected. For example, the display screen 50 can be produced from a continuous sheet of white denier cloth suspended from the rear wall 48. One skilled in the art will recognize several alternative realizations of the display screen 50, including a white painted layer on the rear wall 48. Alternatively, in some applications the display screen 50 can be replaced by an array of cathode ray tube based devices, liquid crystal displays or any other suitable structure for presenting visible images to the participant 90. Such alternative displays may require adaptation for use in the weapons range 40, such as protective shielding. Such alternative displays may also be used when the participant's fire is nondestructive fire such as an optical beam.

Above the display screen 50, a video camera 52 is mounted on a servo mechanism 54 held to the rear wall 48 by a bracket. The video camera 52 is a conventional wide angle video camera, including a two-dimensional CCD array, and is angled toward the participation zone 42 to allow imaging of substantially the entire participation zone 42. The video camera 52 can thus provide video information regarding action and exposure of the participant 90, as will be discussed in greater detail below.

A pair of electronically controlled return fire simulators 58, 60 are also mounted to the rear wall 48 behind the display screen 50 at vertically and horizontally offset locations. Each of the return fire simulators 58, 60 is preferably a known electronically actuated rifle or similar gun employing nonlethal ammunition and aimed at the participation zone 42. When activated, the return fire simulators 58, 60 emit pellets or similar nonlethal projectiles toward the participation zone 42. Small apertures 63 allow the projectiles to pass through the display screen 50.

The return fire simulators 58, 60 are mounted to separate electronically controlled aiming servos 62, 64 controlled by the central controller 72. The aiming servos 62, 64 pivot the return fire simulators 58, 60 in two orthogonal planes (i.e., horizontal and vertical). The aiming servos 62, 64 can thereby pivot in the horizontal plane to "sweep" the return fire laterally across the participation zone 42 and can pivot in the vertical plane to provide electrical control of the return fire.

The target zone 46 further includes a pair of impact sensors 66, 68 mounted near the display screen 50 and aligned to a retroreflective region 69 that partially encircles the target zone 46. The impact sensors 66, 68 are preferably optical sensors employing light reflected from the retroreflective region 69, as described in greater detail in co-pending U.S. application Ser. No. 08/310,290 to Treat et al. which is commonly assigned with the present application and is incorporated herein by reference. Alternatively, the impact sensors 66, 68 can be any other conventional structure for detecting impact locations of simulated or actual fire directed toward the display screen 50.

The impact sensors 66, 68, the video camera 52, the servo mechanism 54, the return fire simulators 58, 60, and the aiming servos 62, 64 are connected to the central controller 72 by respective cables 70 routed outside of the target and participation zones 46, 42. A microprocessor 74 operates the central controller 72 in response to a selected computer program and/or input from an input panel 76, which may be a keyboard, mouse, touch screen, voice recognition, or other conventional input device. In addition to the input panel 76 and the microprocessor 74, the central controller 72 includes an X-Y decoder 78, a discriminator 80, a laser disk player 82 and a local monitor 86. The structure and operation of the microprocessor 74, the X-Y decoder 78, the discriminator 80, the disk player 82 and the display will be described in greater detail below.

At the opposite end of the range 40 from the target zone 46, the participation zone 42 provides an area for a participant 90 to participate. The participant 90 is armed with a weapon 91 that shoots projectiles, such as bullets or pellets, toward the display screen 50. The weapon 91 also includes a shot counter coupled to a small transmitter (not visible) that provides a shot count to the microprocessor 74 through an antenna 106, as discussed below. Alternatively, a conventional acoustic sensor can detect the weapon's report to monitor shots fired by the weapon 91. Also, although the weapon 91 preferably fires actual projectiles, weapons 91 emitting other forms of simulated fire, such as optical beams, may also be within the scope of the invention.

An X-Y sensor 88, coupled to the X-Y decoder 78, lies beneath the participation zone 42 to detect the participant's position. The X-Y sensor 88 is a pressure sensitive pad that detects the location of a participant 90 by sensing the weight of the participant 90. The X-Y sensor 88 transmits this information to the X-Y decoder 78 which produces locational information to the microprocessor 74.

The participation zone 42 also includes obstructions 92 positioned between the X-Y sensor 88 and the target zone 46, preferably immediately adjacent the X-Y sensor 88. The obstructions 92 are simulated structures, such as simulated rocks, building structures, garbage cans, or any other type of obstruction that might be found in a "real life" environment. As can best be seen in FIG. 2, the obstructions 92 produce fully shielded regions 93, partially shielded regions 95 and exposed regions 97 within the participation zone 42 by blocking return fire from the return fire simulators 58, 60. The participant 90 is free to move around the obstructions 92, because the weapon 91 is untethered. Thus, the participant 90 can move freely among the regions 93, 95, 97.

The intermediate zone 44 separates the target zone 46 and the participation zone 42. The intermediate zone 44 contains an image projector 94, such as a television projector, a secondary impact sensor 96 and speakers 98. The image projector 94 projects images on the display screen 50 in response to input signals from the disk player 82 which is controlled by the microprocessor 74. The disk player 82 is a commercially available laser disk player such as a Pioneer LD4400 disk player. The disk player 82 contains a conventional optical disk containing a selected multi-branch simulation, where the branches are selected by a software program stored in a memory coupled to the microprocessor 74. Such multi-branch simulations and related programs are known, being found in common video games. As will be discussed below in greater detail, the microprocessor 74 selects successive branches based upon input from the impact sensors 66, 68, 96, the discriminator 80, the X-Y decoder 78, the input panel 76, and the weapon 91. The microprocessor 74 can thus select scenarios from those stored on the laser disk to present to the participants 90. To make the scenarios more realistic, the speakers 98 provide audio information, such as sounds corresponding to the displayed scenario or commands to the participant 90.

The secondary impact sensor 96 is an optical sensor that detects the impact location of fire from the participant 90 and provides additional information regarding hit locations to the central controller 72. The secondary impact sensor 96 can also allow detection of simulated fire when the weapon 91 is an optical emitter rather than a projectile emitter. To prevent the image projector 94, secondary impact sensor 96 and speakers 98 from being struck by stray fire, the image projector 94, secondary impact sensor 96 and speakers 98 are positioned out of the line of fire.

Figure 4:
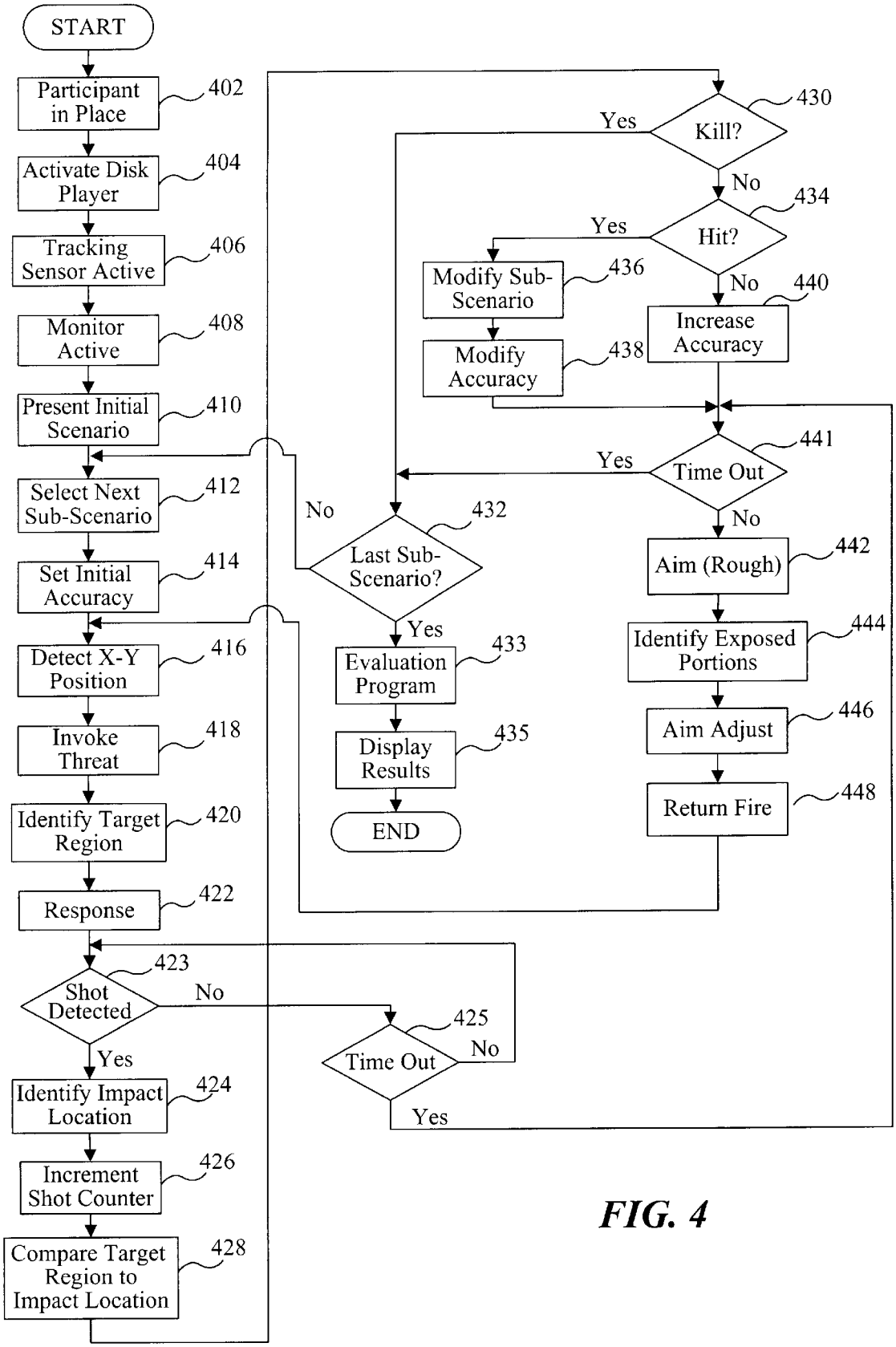
FIG. 4 is a flowchart representing the method of operation of the weapons training environment of FIG. 1.

Operation of the weapons training range 40 will now be described with reference to the flow chart of FIG. 4. The simulated experience begins when the participant 90 is positioned in the participation zone 42 or is positioned to enter the participation zone 42, in step 402. In response to an input command at the input panel 76 or detected entry of the participant 90 into the participation zone 42, the microprocessor 74 activates the disk player 82 in step 404. At about the same time, the video camera 52 images the participation zone 42 in step 406 and provides a visual display to an observer (not shown) on the monitor 86 in step 408.

In step 410, the microprocessor 74 selects a branch of the multi-branch simulation to cause the image projector 94 and speakers 98 to present to the participant 90 a simulated initial scenario, such as a combat environment or simulated police action environment. In step 412, the microprocessor 74 selects a branch of the multi-branch simulation containing a threatening subscenario, such as an armed enemy. The microprocessor 74 then sets an initial aiming accuracy in step 414 and detects the participant's rough X-Y position in step 416, as will be discussed below.

Once the participant's X-Y position is determined, the image projector 94 and speakers 98 present the threatening subscenario in the form of a projected image and related sounds, in step 418. As part of the subscenario, the microprocessor 74 also determines one or more target regions in the target zone 46, in step 420. The target regions are regions toward which the participant 90 is intended to fire. For example, a target region may be a central region of a projected enemy, a spotlight, a tank, or any other object toward which fire might be directed. The target region may also include one or more subregions or "kill zones" which, when struck, kill the enemy or otherwise terminate the threat.

In response to the threatening subscenario, the participant 90 activates the weapon 91 to produce simulated fire in step 422. The microprocessor 74 identifies if a shot has been fired within a time out period in steps 423 and 425. If no shot is fired, the program jumps to step 441, as will be discussed below with respect to timing out of the subscenario. Otherwise, as the simulated fire (represented by arrow 100 in FIG. 1), travels toward the display screen 50, the impact sensors 66, 68 and/or the secondary impact sensor 96 identify the impact location 102 in step 424 and provide the impact location 102 to the microprocessor 74. In step 426, the microprocessor 74 simultaneously increments the shot count for each shot fired.

The microprocessor 74 then compares the detected impact location 102 to the target region in step 428. Depending upon the desirability of the return fire and the impact location 102, the microprocessor 74 may modify the on-going scenario. For example, if the impact location 102 corresponds to a desired kill zone within the target region, the threatening subscenario may terminate at step 430. If the impact location is within the kill zone, the microprocessor 74 then determines if any more subscenarios remain, in step 432. If more subscenarios remain, the next subscenario is selected in step 412 and the above-described steps are repeated.

If no more subscenarios remain, the participant's performance is evaluated in a conventional manner. For example, the software may provide efficiency and accuracy scores based upon number of shots fired, estimated damage to the enemy and estimated damage to the participant 90, in step 433. The monitor 86 then presents the results of the evaluation in step 435.

If the impact location 102 is within the target region, but not within the kill zone in step 434, the microprocessor 74 determines whether the impact location 102 is in a damaging, but nonlethal subregion of the target region in step 434. In response to such a "nonlethal hit," the microprocessor 74 may modify the subscenario in one of several selected fashions in step 456. For example, the microprocessor 74 may select a wounding subscenario where the enemy remains active, but impaired in step 436. The microprocessor 74 in step 438 may also adjust the accuracy of return fire based upon the nonlethal hit. For example, if the participant 90 scores a nonlethal hit at a location that would be expected to decrease the accuracy of the threat (e.g., the enemy's shooting hand), the microprocessor 74 increases the aiming error in step 438.

If the impact location 102 is not within the target region (i.e., a "miss"), the microprocessor 74 increases the aiming accuracy as a function of elapsed time in step 440 to improve the realism of the simulation. The gradual increase in aiming accuracy over time simulates refinement of the enemy's aim. Timing of the subscenario also allows the subscenario to end without a kill. In step 441, if too much time elapses without a kill, the subscenario ends and the program returns to step 432 to determine if additional subscenarios remain.

Whether the impact location 102 is a nonlethal hit or a miss, the microprocessor 74 may selectively activate one or both of the return fire simulators 58, 60 to produce return fire. To produce the return fire, the microprocessor 74 first activates the aiming servos 62, 64 in step 442 to aim the return fire simulators 58, 60 at the approximate location of the participant 90 determined in step 416. Next, in step 444 the microprocessor 74 attempts to identify exposed portions of the participant 90. To identify exposed portions of the participant 90, the video camera 52 provides the image information to the discriminator 80. The discriminator 80 is a commercially available image processing device. The discriminator 80 monitors the image signal from the video camera 52 and identifies local contrasts in the image signal that may be caused by exposed portions of the participant 90. To increase the sensitivity of the video camera 52 and discriminator 80, the participant 90 wears clothing having a reflective, retroreflective, or selectively colored exterior. The clothing thus increases contrast between the participant 90 and the rest of the participation zone 42.

The microprocessor 74 receives the information concerning exposed portions of the participant 90 and adjusts the aiming according to an aiming program in step 446. If the discriminator 80 identifies a clearly exposed portion of the participant 90, the microprocessor 74 adjusts the aim of the return fire simulators 58, 60 through the aiming servos 62, 64 in step 446 to direct the simulated return fire at the exposed portion identified in step 448.

If the microprocessor 74 is unable to identify an acceptable exposed portion of the participant 90 in step 444, the microprocessor 74 may elect in step 448 to direct return fire at or near the perimeter of the nearest obstruction 92. Such fire provides a deterrent to prevent the participant 90 from moving to an exposed position. Such fire also provides an audible indication of return fire accuracy by striking the obstruction 92 to produce noise or to produce a "whizzing" sound as projectiles pass nearby.

Alternatively, if the X-Y decoder 78 indicates that the participant 90 has chosen a position that is vulnerable to indirect fire, the microprocessor 74 may aim the return fire simulators 58, 60 to direct deflected fire toward the participant 90. For example, as seen in FIG. 2, return fire from the return fire simulator 60 is blocked from directly reaching the participant 90. However, the return fire simulator 60 may aim at a rear obstruction 104 in an attempted "bank shot." That is, the return fire simulator 60 may direct the simulated return fire at the rear obstruction 104 such that the simulated return fire can rebound from the rear obstruction 104 toward the participant 90. After the simulators 58, 60 return fire, the program returns to step 416 to determine whether the participant has moved and the threat is reinvoked in step 418. The above-described steps are repeated until the enemy is killed in step 430 or the maximum time elapses in step 441.

In addition to directing fire toward the target zone 46, the weapon 91 also transmits through the antenna 106 a coded digital signal indicating the firing of shots. A receiver 108 in the central controller 72 detects the signal from the antenna 106 and provides an update to the microprocessor 74 of the number of shots fired by the weapon 91. The microprocessor 74 tracks the number of shots fired and compares them to the number of hits to provide a scoring summary indicating the accuracy and efficiency of the participant 90 in the scenario.

Additionally, the microprocessor 74 can adapt the subscenario according to the shot count. For example, the microprocessor 74 may detect when the participant 90 is out of "ammunition" and adjust the actions of the enemy in response. Additionally, in some embodiments, the weapon 91 includes a radio receiver and a disable circuit (not shown). In such embodiments, the microprocessor 74 activates a transmitter 110 to produce a disable signal. The weapon 91 receives the disable signal and disables firing. When the microprocessor 74 determines that the participant 90 has successfully reloaded, either through a reloading timer or a signal from the weapon 91, the microprocessor 74 transmits an enable signal through the transmitter 110. The weapon 91 receives the enable signal through the antenna 106 and reenables firing. Such temporary disabling of the weapon 91 more realistically simulates the real world environment by inducing the participant 90 to more selectively utilize ammunition and by imposing reloading delays.

Figure 5:
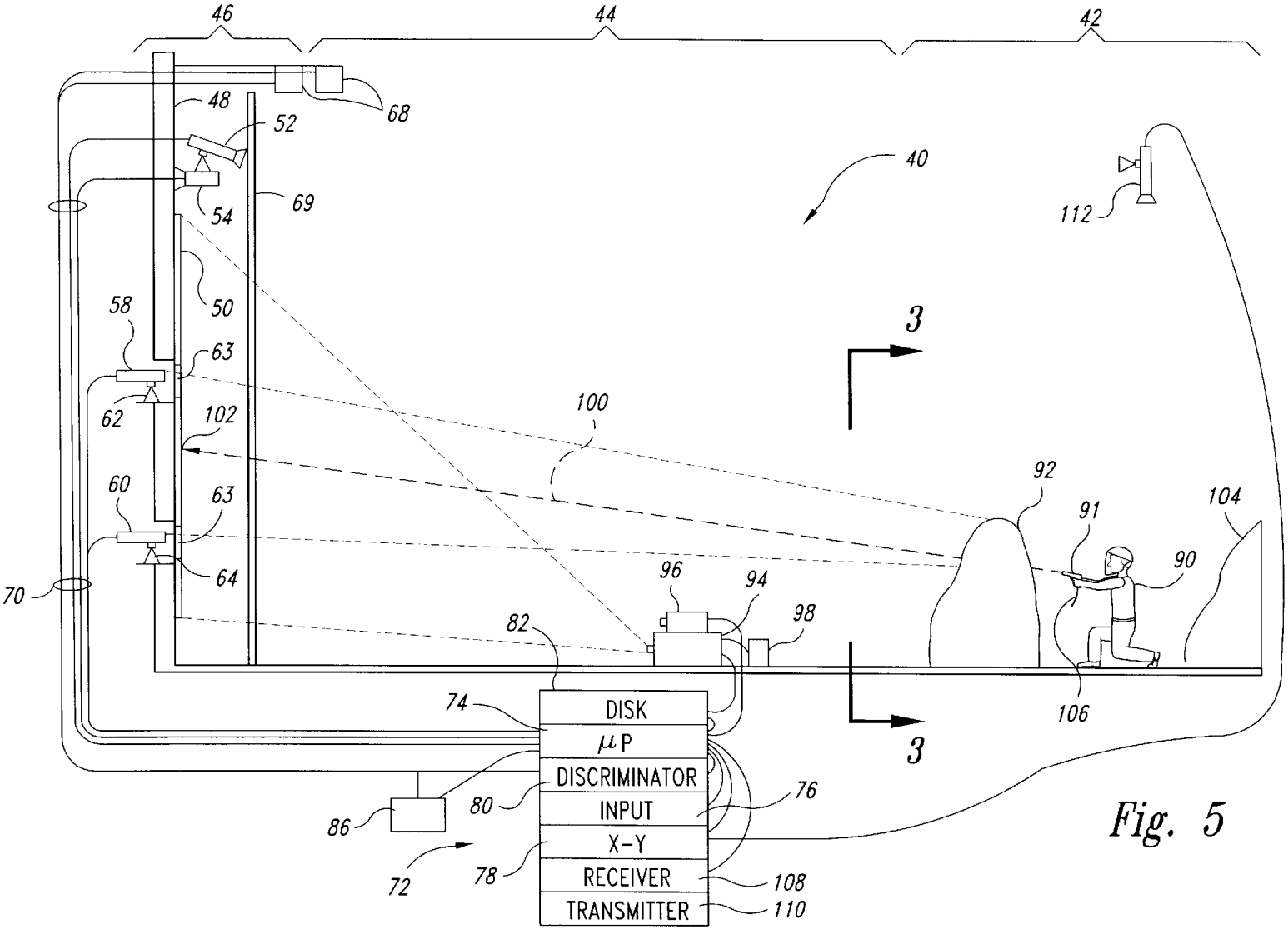
FIG. 5 is a side elevational view of an alternative embodiment of the weapons range having an overhead camera.
Figure 6:
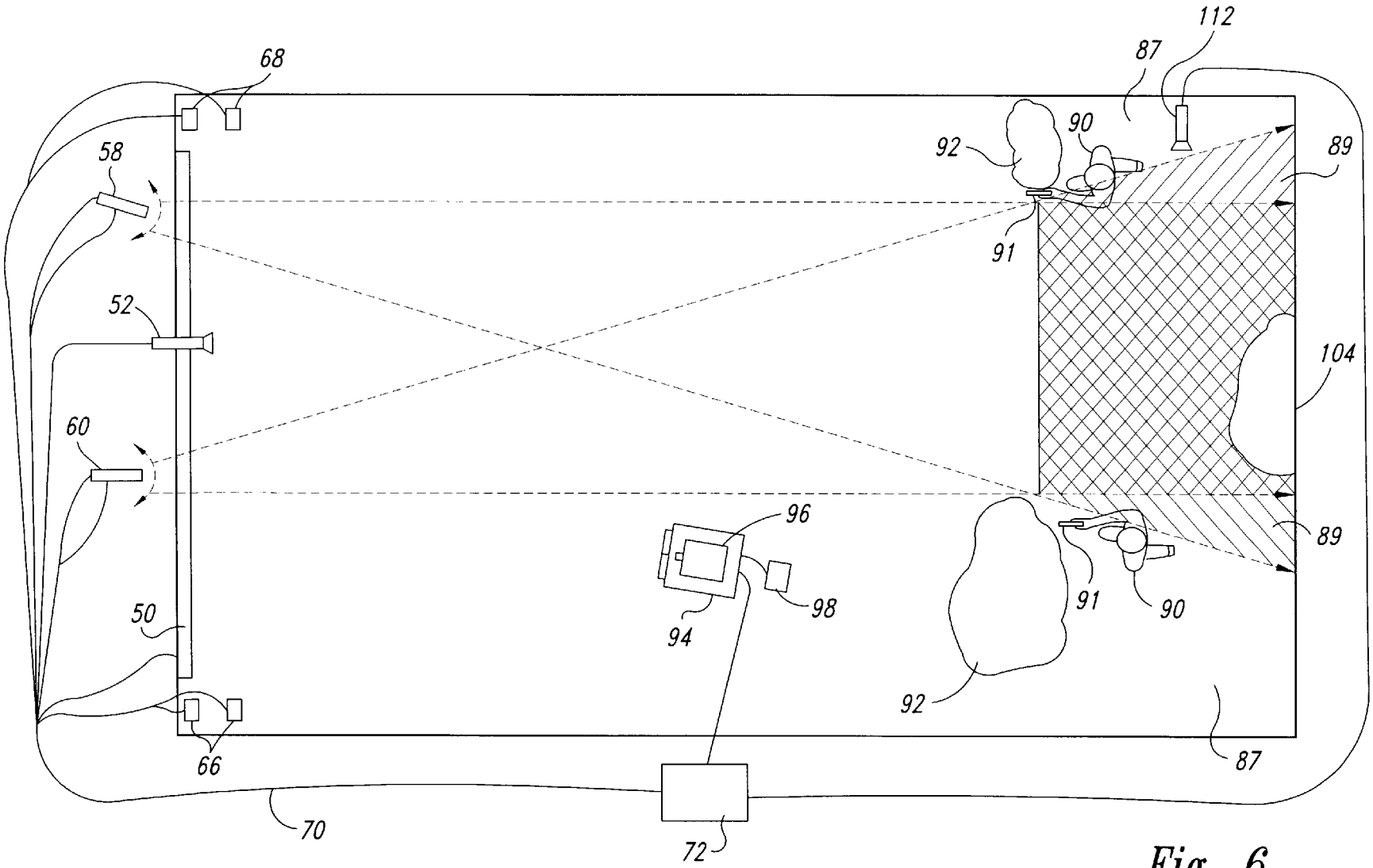
FIG. 6 is a top plan view of the weapons range environment showing two participants.

FIGS. 5 and 6 show an alternative embodiment of the range 40 that allows more than one participant 90 to participate in a simulation. In this embodiment, the X-Y sensor 88 is replaced by an overhead camera 112. The overhead camera 112 images the participation zone 42 and provides to the microprocessor 74 a continuous indication of the participants' positions.

Additionally, in this environment, the coded digital signals transmitted by the weapons 91 to the receiver 108 include an additional data field identifying the particular weapon 91. The microprocessor 74 can therefore track shot counts for more than one weapon 91.

The alternative range 40 of FIGS. 5 and 6 also includes two separate sets of impact sensors 66, 68 and the weapons 91 fire retroreflectively coated projectiles. The retroreflective coatings on the projectiles are color selective so that projectiles from the first weapon 91 reflect different wavelengths of light from those of the second weapon. The impact sensors 66, 68 in each set are optimized to the wavelength of their respective weapons, so that the impact sensors 66, 68 can distinguish between simultaneous fire from the first and second weapons 91.

Alternatively, the weapons 91 can emit optical beams rather than coated projectiles. In such a case, the secondary impact sensor 96 detects the impact location of the respective optical beams. To identify the weapon 91 being fired, the respective optical beams can be at different wavelengths or can be pulsed in readily distinguishable patterns.

While the invention has been presented herein by way of exemplary embodiments, one skilled in the art will recognize several alternatives that are within the scope of the invention. For example, the return fire simulators 58, 60 are described herein as being aimed by aiming servos 62, 64 from fixed locations. However, a variety of other aiming mechanisms may be within the scope of the invention. Similarly, the return fire simulators 58, 60 need not be mounted at fixed locations. Instead, the return fire simulators 58, 60 may be made mobile by mounting to tracks or any other suitable moving mechanism.

Additionally, the preferred embodiment employs a multibranch program on a laser disk. However, a variety of other types of devices may be employed for producing the simulation and displaying scenarios and subscenarios. For example, the scenarios and subscenarios can be produced through computer-generated or other animation. Also, the display screen 50 may be rear illuminated, may be a cathode ray tube or LCD system, or the subscenarios may be presented through mechanically mounted images. Moreover, where mechanical or other alternative displays are used in place of the image projector 94, the disk player 82 can be eliminated or replaced with an alternative source of a multibranch simulation. Also, although the simulated return fire is preferably in the form of emitted projectiles, other types of simulated return fire may be within the scope of the invention. For example, the simulated return fire may be an optical beam directed toward the participant 90. Hits on the participant 90 would then be identified by optical sensors on the participant's clothing. Furthermore, while the preferred embodiment of the invention employs the video camera 52 and discriminator 80, any other suitable system for identifying the participant's location and the location of any exposed portions may be within the scope of the invention. Accordingly, the invention is not limited except as by the appended claims.

We claim:

1. An interactive weapons range environment comprising:

an electronic central controller, the central controller having a first output for providing a return fire signal;

a participation zone;

an electrically controlled return fire simulator aligned to the participation zone, the return fire simulator being coupled to receive the return fire signal from the central controller, the return fire simulator being operative to emit simulated return fire toward the participation zone in response to the return fire signal; and a participant detector aligned to the participation zone, the detector further being aligned to detect a participant within the participation zone and coupled to provide a signal to the central controller in response to the detection, wherein the central controller further includes an alignment output for supplying an alignment signal and the return fire simulator includes an alignment input coupled to receive the alignment signal from the central controller and wherein the return fire simulator is alignable to a selected location in the participation zone in response to the alignment signal from the central controller.

2. The interactive weapons range environment of claim 1, further including an obstruction positioned to obscure a first portion of the participation zone from the return fire simulator and to expose a second portion of the participation zone to the simulated return fire.

3. The interactive weapons range environment of claim 2, wherein the participant detector comprises an exposure detector aligned to the participation zone, the exposure detector further being aligned to detect a portion of the participant within the exposed second portion of the participation zone.

4. The interactive weapons range environment of claim 3 wherein the exposure detector includes an imaging camera.

5. The interactive weapons range environment of claim 4 wherein the exposure detector further includes a discriminator coupled to the imaging camera.

6. The interactive weapons range environment of claim 1 wherein the central controller further includes a position input, wherein the participant detector comprises a position detector aligned to the participation zone, the position detector being operative to detect a position of the participant within the participation zone, the position detector being coupled to provide a position signal to the central controller in response to the position signal.

7. The interactive weapons range environment of claim 6 wherein the position detector includes a pressure pad beneath the participation zone.

8. The interactive weapons range environment of claim 6 wherein the position detector includes an optical imaging system positioned to image the participation zone.

9. The interactive weapons range environment of claim 1 wherein the simulated return fire includes projectiles emitted toward the participation zone.

10. The interactive weapons range environment of claim 9 wherein the return fire simulator includes an electronically actuated projectile emitter.

11. The interactive weapons range environment of claim 10 wherein the electronically actuated projectile emitter includes an electronically actuated gun.

12. The interactive weapons range environment of claim 10 wherein the return fire simulator includes an electronically controllable aiming mechanism coupled for control by the central controller.

13. The interactive weapons range environment of claim 12 wherein the electronically controlled aiming mechanism includes a servo-mechanism coupled to the projectile emitter.

14. The interactive weapons range environment of claim 13 wherein the aiming mechanism further includes an elevational control mechanism controlled by the central controller.

15. The interactive weapons range environment of claim 1, further including an interactive display controlled by the central controller.

16. The interactive weapons range environment of claim 15 wherein the interactive display is operative to present video images.

17. The interactive weapons range environment of claim 15 wherein the interactive display is operative to present computer-generated animation.

18. The interactive weapons range environment of claim 15 wherein the interactive display includes:

a display screen; and an image projector aligned to the display screen, the image projector being coupled for control by the central controller.

19. The interactive weapons range environment of claim 15, further including a multi-branch image program under control of the central controller and wherein an image projector is operative to present a first set of selected images in response to a first set of selected branches and to present a second set of selected images in response to a second set of selected branches.

20. The interactive weapons range environment of claim 15, further including:

a hand-held weapon for firing simulated rounds at a displayed image, the weapon having a selected number of simulated rounds in a reload; and a shot counter coupled to the central controller, the counter being coupled to detect the number of simulated rounds fired by the weapon.

21. The interactive weapons range environment of claim 20 wherein the weapon is an untethered weapon.

22. The interactive weapons range environment of claim 21 wherein the weapon includes a radiowave transmitter for transmitting signals to the central controller.

23. A virtual training environment, comprising:

a participation zone;

an image display, the image display including a selectable target area;

a weapon adapted for use by a participant, the weapon being aimable toward the target area, the weapon being operative to emit simulated fire in response to participant input;

an impact detector positioned to detect impact of the simulated fire at the target area;

an electronic central controller; and a return fire weapon coupled for control by the central controller, the return fire weapon being aimable into the participation zone and operative to emit simulated return fire, the return fire weapon being responsive to a position the participant in the participation zone, the return fire weapon including an electronically controllable aiming mechanism coupled for control by the central controller.

24. The virtual training environment of claim 23 wherein the return fire weapon includes an electronically actuated projectile emitter.

25. The virtual training environment of claim 24 wherein the electronically actuated projectile emitter includes an electronically actuated gun.

26. The interactive weapons range environment of claim 24, further including an obstruction positioned to block emitted projectiles from directly reaching a first portion of the participation zone and to permit emitted projectiles to travel directly to a second portion of the participation zone.

27. The virtual training environment of claim 23 wherein the weapon includes an optical emitter.

28. The virtual training environment of claim 23 wherein the electronically controlled aiming mechanism includes a servo-mechanism.

29. The virtual training range environment of claim 28 wherein the aiming mechanism further includes an elevational control mechanism controlled by the central controller.

30. The virtual training range environment of claim 23, further comprising a position detector aligned to the participation zone, the position detector being operative to detect the position of the participant within the participation zone, the position detector being coupled to provide a position signal to the central controller in response to the detected position.

31. The virtual training range environment of claim 23, further including:

an obstruction positioned to obscure a first portion of the participation zone from the simulated return fire and to expose a second portion of the participation zone to the simulated return fire; and an exposure detector aligned to the participation zone, the exposure detector further being aligned to detect a portion of the participant within the exposed second portion of the participation zone, the exposure detector being coupled to provide an exposure signal to the central controller in response to the detected position of the participant with respect to the second portion of the participation zone.

32. A method of providing a simulated conflict situation to a participant in a participation zone, comprising:

presenting a visually recognizable scenario to the participant;

selecting threatening subscenarios:

modifying the visually recognizable scenario by selectively presenting the selected threatening subscenarios;

emitting simulated return fire in response to the selected threatening subscenarios;

selecting regions of the participation zone based on a prescence of the participant with respect to the regions including monitoring the position of the participant within the participation zone and selecting the regions in response the monitored position;

directing the simulated return fire toward the selected regions of the participation zone;

detecting responses of the participant to the threatening subscenarios;

aiming a return fire simulator toward the selected regions including aligning the return fire simulator to the selected regions; and inducing a selected misalignment error.

33. The method of claim 32, further including monitoring the position of the participant within the participation zone.

34. The method of claim 32 wherein inducing a selected misalignment error includes:

selecting an initial error; and selectively adjusting the initial error to produce the misalignment error.

35. The method of claim 34 wherein selectively adjusting the initial error to produce the misalignment error includes:

detecting passage of time; and in response to the detected passage of time, decreasing the misalignment error.

36. The method of claim 35 wherein selectively adjusting the initial error to produce the misalignment error further includes decreasing the misalignment error in response to a detected response of the participant to the threatening subscenarios.

37. The method of claim 32, further including enabling the participant to direct simulated fire toward selected target regions and wherein detecting responses of the participant to the threatening subscenarios comprises monitoring the simulated fire of the participant.

38. The method of claim 32 wherein detecting responses of the participant to the selected threatening subscenarios includes counting a number of shots fired by the participant with a weapon, and further including:

comparing the number of shots fired by the participant to a selected shot count; and when the number of shots fired exceeds the selected number, disabling the weapon.

39. The method of claim 38, further including the step of reenabling the weapon after a selected disable period.

40. The method of claim 32 wherein presenting a visually recognizable scenario to the participant includes producing at least one computer-generated scenario.

41. An interactive weapons range environment, comprising:

an electronic central controller, the central controller having a first output for providing a return fire signal;

a participation zone; and an electrically controlled return fire simulator aligned to the participation zone, the return fire simulator being coupled to receive the return fire signal from the central controller, the return fire simulator being operative to emit simulated return fire including projectiles toward the participation zone in response to the return fire signal, the return fire simulator including an electronically controllable aiming mechanism coupled for control by the central controller.

42. The interactive weapons range environment of claim 41 wherein the return fire simulator includes an electronically actuated projectile emitter.

43. The interactive weapons range environment of claim 42 wherein the electronically actuated projectile emitter includes an electronically actuated gun.

44. The interactive weapons range environment of claim 41 wherein the electronically controlled aiming mechanism includes a servo-mechanism coupled to the projectile emitter.

45. The interactive weapons range environment of claim 44 wherein the aiming mechanism further includes an elevational control mechanism controlled by the central controller.

46. A virtual training environment, comprising:

a participation zone;

an image display, the image display including a selectable target area;

a weapon adapted for use by a participant, the weapon being aimable toward the target area, the weapon being operative to emit simulated fire in response to participant input;

an impact detector positioned to detect an impact of the simulated fire at the target area;

an electronic central controller; and an electronically actuated projectile emitter coupled for control by the central controller, the electronically actuated projectile emitter being aimable into the participation zone and operative to emit simulated return fire including projectiles, the electronically actuated projectile emitter including an electronically controllable aiming mechanism coupled for control by the central controller.

47. The virtual training environment of claim 46 wherein the electronically actuated projectile emitter includes an electronically actuated gun.

48. The interactive weapons range environment of claim 47, further including an obstruction positioned to block emitted projectiles from directly reaching a first portion of the participation zone and to permit emitted projectiles to travel directly to a second portion of the participation zone.

49. The virtual training environment of claim 46 wherein the electronically controlled aiming mechanism includes a servo-mechanism.

50. The virtual training range environment of claim 49 wherein the electronically controlled aiming mechanism further includes an elevational control mechanism controlled by the central controller.

51. A method of providing a simulated conflict situation to a participant in a participation zone, comprising:

presenting a visually recognizable scenario to the participant;

selecting threatening subscenarios;

modifying the visually recognizable scenario by selectively presenting the selected threatening subscenarios;

emitting simulated return fire in response to the selected threatening subscenarios;

selecting regions of the participation zone;

directing the simulated return fire toward the selected regions of the participation zone; and inducing a selected misalignment error into the step of directing the simulated return fire.

52. The method of claim 51 wherein the step of inducing a selected misalignment error includes the steps of:

selecting an initial error; and selectively adjusting the initial error to produce the misalignment error.

53. The method of claim 51 wherein the step of selectively adjusting the initial error to produce the misalignment error includes the steps of:

detecting passage of time; and in response to the detected passage of time, decreasing the misalignment error.

54. The method of claim 53 wherein the step of selectively adjusting the initial error to produce the misalignment error further includes the step of in response to a detected response of the participant to the threatening subscenarios, decreasing the misalignment error.

* * * * *